US006672621B1

(12) United States Patent
Moss

(10) Patent No.: US 6,672,621 B1
(45) Date of Patent: Jan. 6, 2004

(54) HOLDING DEVICE FOR A BOOK OR BINDER

(76) Inventor: James W. Moss, 12311 Taylorsville Rd., Louisville, KY (US) 40299

( * ) Notice: Subject to any disclaimer, the term of this patent is extended or adjusted under 35 U.S.C. 154(b) by 0 days.

(21) Appl. No.: 10/370,867

(22) Filed: Feb. 20, 2003

Related U.S. Application Data

(63) Continuation-in-part of application No. 10/022,657, filed on Dec. 17, 2001, now Pat. No. 6,527,300.

(51) Int. Cl.[7] ..... B42F 21/00

(52) U.S. Cl. ..... 281/36; 24/67 R; 206/472; 281/15.1; 281/29; 281/45; 402/4

(58) Field of Search ..... 281/15.1, 29, 35, 281/36, 45, 48, 51; 402/4, 80 R; 206/472; 24/67 R, 67.5

(56) References Cited

U.S. PATENT DOCUMENTS

| | | | | | |
|---|---|---|---|---|---|
| 4,988,229 | A | * | 1/1991 | Ramsey, III | 402/4 |
| 5,246,251 | A | * | 9/1993 | Evans | 281/42 |
| 5,417,456 | A | | 5/1995 | Laubacher | |
| 5,421,616 | A | * | 6/1995 | Laubacher | 281/45 |
| 5,456,497 | A | * | 10/1995 | Ross, Jr. | 281/42 |
| D414,211 | S | * | 9/1999 | Williams | D19/91 |
| 6,527,300 | B1 | * | 3/2003 | Moss | 281/36 |

* cited by examiner

*Primary Examiner*—Monica S. Carter
(74) *Attorney, Agent, or Firm*—Charles G. Lamb; Middleton Reutlinger

(57) ABSTRACT

A device that aids in the holding of a book or binder is fully adjustable to the hand size of the holder by parting and remating of hook and loop fastening strips attached to U-shaped clips, the U-shaped clips being placed at the top and bottom of the outside surface of the backbone or spine of a book or binder.

10 Claims, 2 Drawing Sheets

HOLDING DEVICE FOR A BOOK OR BINDER

CROSS-REFERENCE TO RELATED APPLICATIONS

This is a continuation-in-part of patent application Ser. No. 10/022,657 filed Dec. 17, 2001.

BACKGROUND OF THE INVENTION

The present invention relates to a holding device for a book, binder, notebook, or the like, and more particularly relates to a holding device for holding a book, binder, or the like that can be comfortably held in the hand for an extended period of time.

Devices are known for assisting in the holding of a book in making a sales presentation, reading from a book, or singing from a song book, wherein a platform, podium or other resting place for the book is not practical or desirable.

Balancing an open loose-leaf binder, book, or other read-from devices in one hand while turning pages to search for particular information or documents contained in the book or binder or the like, can be difficult and may be particularly frustrating. Balancing, rather than firmly holding a book or the like for extended periods of time can also be tiring and conducive to risk fatigue. Particularly, when a person is singing in a choir or other choral group, the singer holds the music book or hymnal between the fingers of one hand and after an extended period of time it is common for cramps to develop in the hands and therefore the holding of the song book or hymnal becomes very tedious to hold. U.S. Pat. No. 5,417,456 to Laubacher teaches a book holding device comprised of the fabrication of several materials, such as an elastic band loop, covered with terry cloth attached to a loop type fastener. This loop type fastener is mateable with a hook type fastener that has been previously attached to the book or binder by means of a pressure sensitive adhesive. The elastic band loop is adapted to receive a hand for holding the book. However, one problem encountered with books and binders is that these books and binders, in many instances, contain vinyl or polyethylene sheeting which constantly exudes a resin which by its very nature affects adhesive attachment in a negative way. In this case the integrity of the adhesive is compromised by the exuded resins thereby causing a separation or release where a tight bond is needed. Moreover, the pressure of the finger and thumb tip on the surface of the binder creates a reverse pressure on the back of the hand to the added pressure causing the adhesive to pull away from the vinyl, polyethylene sheeting, or other types of surfaces.

SUMMARY OF THE INVENTION

It is an object of the present invention to provide a holding device for a book or binder that can be held in an individual's hand for long periods of time without causing cramps or like in the hands.

It is another object of the present invention to provide a holding device for books, binders, notebooks, or the like, which is easy to assembly onto the spine of a book which is adapted to receive the hand of a user.

It is also an object of the present invention to provide a holding device for a book or binder which provides a comfortable way for the holder of the book or binder to hold the book or binder in either hand.

It is even another object of the present invention to provide a holding device for a book or binder which utilizes hook and loop type fasteners which provide for a removably attachable book holding device.

It is even a further object of the present invention to provide a book holding device which includes hook and loop type fasteners thereby providing a holding device capable for use with books or binders of various sizes.

It is also an object of the present invention to provide a device for retaining non-perforated books, leaves, or pamphlets of various dimensions and thickness in a book or binder not having rings or other mechanisms to retain such books, leaves, or pamphlets, by the use of self-adjusting elastic cords or bands in a binder or folder.

It is even another object of the present invention to provide a device for holding a book or binder which is relatively inexpensive and easily changed from one book to another.

More particularly, the present invention provides a holding device for a book which includes first and second U-shaped clips having a back leg and a spaced front leg. Each of the U-shaped clips is provided with a strip of flexible material having one end attached to a front leg of the U-shaped clip and an opposed end with an adjustable fastening device thereon, the adjustable fastening devices on the opposed ends being mateable. Moreover, the front leg of the U-shaped clip may be modified to include an outwardly extending lip with at least one finger thereon to receive a wire or rubber band or the like thereon which is attachable to the top and bottom spine of a binder or folder which allows the receipt of a book, pamphlet, or the like, the book or pamphlet being received between the spine of the binder and the wire, rubber band, or the like.

BRIEF DESCRIPTION OF THE DRAWINGS

A better understanding of the invention will be had upon reference to the following description in conjunction with the accompanying drawings in which like numerals refer to like parts in the various views and wherein.

DETAILED DESCRIPTION OF THE PREFERRED EMBODIMENT

Figure 1:
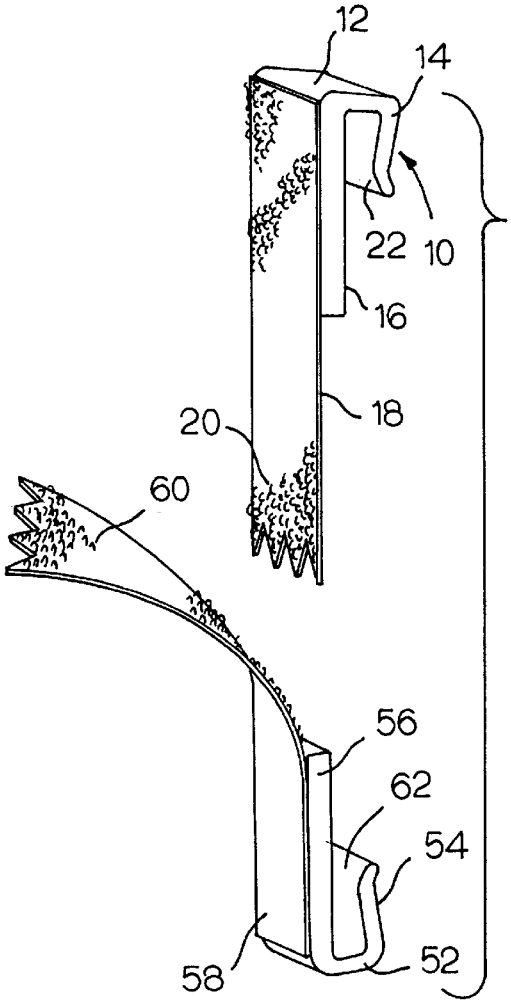
FIG. 1 is a perspective view of one preferred embodiment of the present invention.
Figure 2:
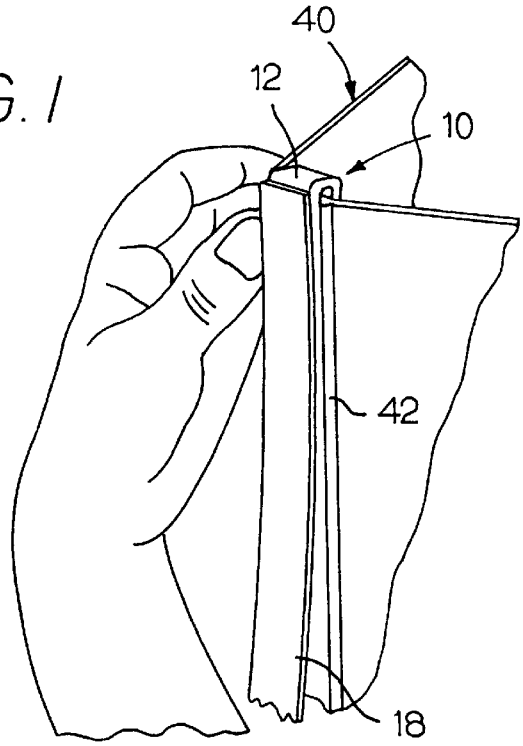
FIG. 2 is a perspective view showing the embodiment of FIG. 1 being attached to a book or binder.
Figure 3:
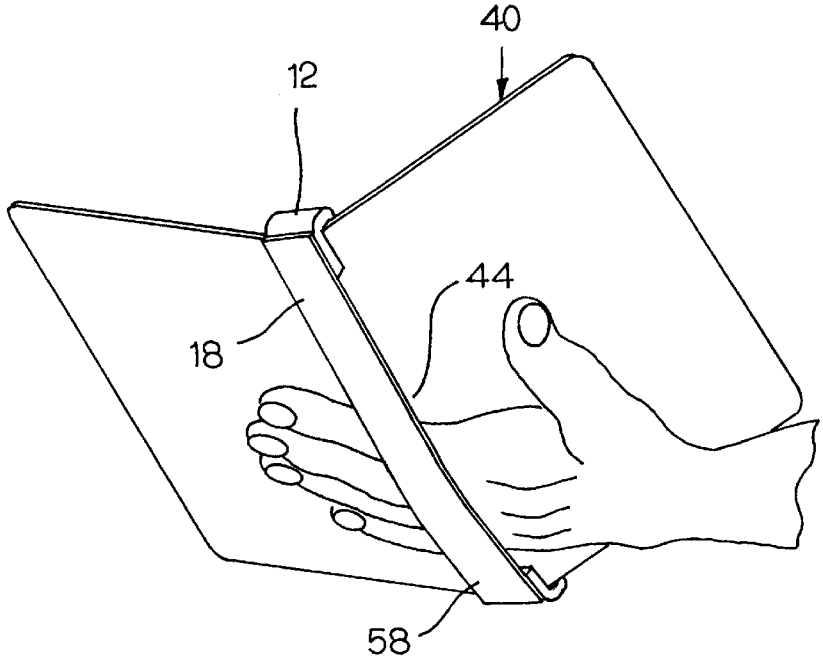
FIG. 3 is a perspective view of the embodiment of FIG. 1 shown in a use condition.

As shown in FIGS. 1–3, a book holding device 10 is provided with a pair of clips 12 and 52 for attaching to the spine or backbone 42 of a book or binder 40. The clips 12 and 52 are generally made of a resilient material, such as a plastic or a selected metal, such as aluminum, and are of generally U-shaped or J-shaped configuration with a back leg 14 and 54, respectively, and a front leg 16 and 56, respectively. To the front legs 16, 56 are attached straps or strips 18 and 58, respectively, of a fabric or other type flexible material which is attached at one end to the front legs 16, 56 of clips 12, 52. Strips 18 and 58 may be attached to the legs 16 and 56 by any conventional means, such as an adhesive, grommets, or the like. At the opposed ends of the strips 18 and 58 are adjustable mating fastening devices, as identified by the numerals 20 and 60, respectively. In a preferred embodiment the fasteners are made of hook and loop fasteners, such as VELCRO. Other fasteners may include buckle fastening devices well know for adjusting belt sizes as well as a hole-and-pin system which is well known for use on the back of ball caps for adjusting ball caps to various head sizes. Moreover, in a preferred embodiment the front legs 16, 56 are longer than the back legs 18, 54 thereby providing more surface area for attaching the straps 18 and 58 to the front legs. Also, in a preferred embodiment, the back legs 14 and 54 are of generally V-shaped construction or are provided with lip portions 22 and 62, respectively, which extend inwardly toward the front legs 16 and 56, respectively.

In the installation of the holding device 10 of the present invention, clips 12 and 52 are attached over the top and bottom outer edges of the backbone or spine 42 of a book or binder 40. Faces of the adjacent surfaces of the hook fastener 20 and the loop fastener 60 are then brought together to form a fully adjustable single strap support for the hand which is placed in the opening 44 defined by the straps 18, 58 and the backbone or spine 42.

Figure 4:
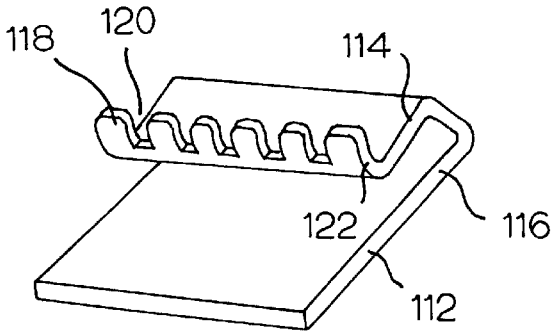
FIG. 4 is a perspective view of another preferred U-or J-shaped clip of the present invention.
Figure 5:
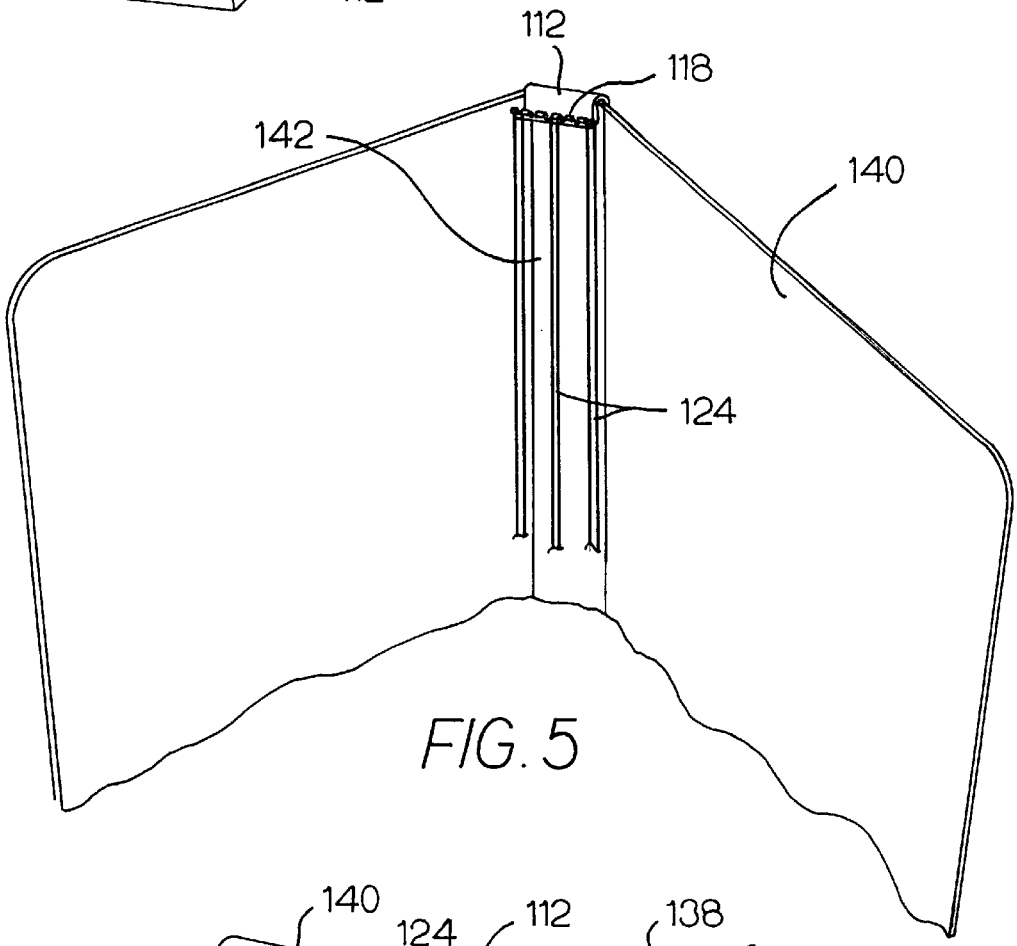
FIG. 5 is a perspective view of the clip of FIG. 4 showing an attachment to a top edge of a binder or folder; and, FIG. 6 is a perspective view of clips of FIG. 4 shown in a use condition when attached to a top edge and a bottom edge of a binder or folder.

In FIG. 4, a clip 112 is shown for attaching to the spine or back bone 142 of a binder or folder 140, as shown in FIG. 5. The clip 112 is generally made of a resilient material, such as a plastic or a selected metal, such as aluminum, and is of generally U-shaped or J-shaped configuration with a back leg 114 and a front leg 116. The terminating end of the back leg 114 is provided with an outwardly extending lip portion 122 with a plurality of fingers 118 spaced therealong. Spacings 120 of a preselected width and depth are provided between the fingers 118.

Referring now to FIG. 5, self-adjusting page retaining strips 124 for retaining non-perforated books, leaves, or pamphlets in place is shown. Strips 124, such as elastic bands, metal wires, rods, or the like are attached to the fingers 118 and in use clips 112 are placed over the top and bottom edges of the spine or back bone 142 of the binder 140 with the strips 124 holding the pages in place.

To the front legs 116 of the clips 112 are attached straps 18 and 58, as shown in FIG. 1 and described hereinbefore.

Figure 6:
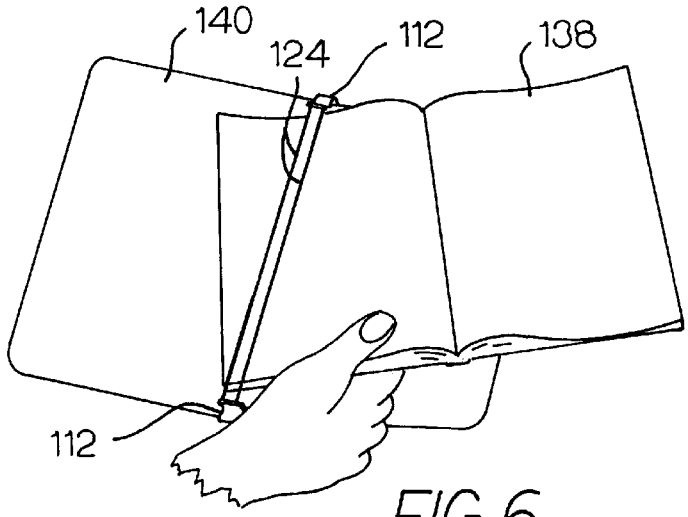

In the use of a holding device, including the clips 112 of the present invention, and as shown in FIG. 6, a pair of clips 112 are attached over the top and bottom edges of the back bone or spine 142 of a binder or folder 140. Faces of the adjacent surfaces of a hook fastener 20 and a loop fastener 60, are then brought together as shown in FIG. 1 to form a fully adjustable single strap support for the hand which is placed in the opening 44 defined by the straps 18, 58, and the back bone or spine 142. One end of the page retaining strips 124 are attached to the fingers 118 on the top clip 112 and the opposing end of the strips 124 are placed on the fingers 118 of the bottom clip 112. A book, pamphlet 138 or the like, is then inserted in the spacing between the strips 124 and the binder 140.

With the clips of 112 and the self-adjusting page retaining strips 124, non-perforated books, leaves, or pamphlets of various dimensions and thickness are held in a selected position within a binder 140.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A holding device for a book comprising:

first and second clips having a back leg and a spaced parallel front leg, said back legs having an outwardly extending lip portion at its terminating lower end;

a first strip of flexible material having a first adjustable fastening device on one end of said first strip of flexible material, said first strip of flexible material having an opposed end attached to a front leg of said first clip; and, a second strip of flexible material having a second adjustable fastening device mateable with said first adjustable fastening device on one end of said second strip of flexible material, said second strip of flexible material having an opposed end attached to said front leg of said second clip.

2. The holding device of claim 1, said front legs of said clips being longer than said back legs.

3. The holding device of claim 1, said first fastening device being a hook fastener and said second fastening device being a loop fastener.

4. The holding device of claim 1, said first and said second fastening devices being mateable hook and loop fasteners.

5. The holding device of claim 1, said clips being of a resilient material.

6. The holding device of claim 5, said resilient materials including plastics and metals.

7. The holding device of claim 1, said back legs being of generally V-shaped construction.

8. The holding device of claim 1, said clips being of generally U-shaped construction with a front leg longer than said back leg.

9. The holding device of claim 8, said lip having at least one outwardly extending finger.

10. The holding device of claim 9, at least one said outwardly extending finger of said first clip having one end of a self-adjusting paper retaining strip attached thereto, and an opposed end of said page retaining strip being attached to at least one said finger of said second clip.

* * * * *